US006546649B1

(12) United States Patent
Tobias

(10) Patent No.: US 6,546,649 B1
(45) Date of Patent: Apr. 15, 2003

(54) PLUSH TOY FOR MOUNTING ON A SHOE

(76) Inventor: Mark Tobias, 4215 Mary Ellen Ave., Apartment # 108, Studio City, CA (US) 91604

( * ) Notice: Subject to any disclaimer, the term of this patent is extended or adjusted under 35 U.S.C. 154(b) by 0 days.

(21) Appl. No.: 10/131,077

(22) Filed: Apr. 25, 2002

Related U.S. Application Data

(62) Division of application No. 09/379,712, filed on Aug. 24, 1999, now abandoned.

(51) Int. Cl.[7] ..... A43B 3/30
(52) U.S. Cl. ..... 36/112
(58) Field of Search ..... 36/136, 132, 112, 36/137; 446/26, 328; 40/636; D2/976

(56) References Cited

U.S. PATENT DOCUMENTS

| | | | | |
|---|---|---|---|---|
| 752,607 | A | 2/1904 | Thowless | |
| 1,218,398 | A | 3/1917 | Gurtov | |
| D70,572 | S | 7/1926 | Myers | |
| 1,947,183 | A | 2/1934 | Bodle | |
| 2,709,870 | A | 6/1955 | Gradwohl | |
| 3,023,420 | A | 3/1962 | Tann | |
| 3,473,198 | A | 10/1969 | Meier | |
| 4,050,168 | A | 9/1977 | Pace | 36/136 |
| 4,637,798 | A | 1/1987 | Maiden-Nesset | |
| 4,712,319 | A | 12/1987 | Goria | 36/137 |
| 4,799,889 | A | 1/1989 | Yockey | |
| 4,805,270 | A | 2/1989 | Kimbrough | 24/117 |
| 5,058,293 | A | 10/1991 | Villar | 36/136 |
| 5,072,843 | A | 12/1991 | James | |
| 5,136,726 | A | 8/1992 | Kellin et al. | 2/244 |
| 5,195,336 | A | 3/1993 | Mershon | 63/29.1 |
| 5,246,749 | A | 9/1993 | Handzlik | 428/8 |
| 5,282,288 | A | 2/1994 | Henson | 12/142 P |
| D351,934 | S | 11/1994 | Devoe | D2/946 |
| 5,379,533 | A | 1/1995 | Swartz | 36/136 |
| 5,596,821 | A | 1/1997 | Solo | 36/136 |
| 5,673,501 | A | 10/1997 | Mathews | 36/136 |
| 5,979,085 | A | 11/1999 | Ross et al. | |

FOREIGN PATENT DOCUMENTS

| | | |
|---|---|---|
| GB | 448680 | 6/1936 |

OTHER PUBLICATIONS

Advertisement page for "Shoelace Buddies", manufactured by King Plush, Patent and Copyright Pending, 1998, King Plush, Inc., Carson, CA. (Including two photographs).

*Primary Examiner*—Ted Kavanaugh
(74) *Attorney, Agent, or Firm*—Shaw Pittman LLP

(57) ABSTRACT

A plush toy is provided that is capable of easily being detachably mounted on a shoe having a shoelace. The plush toy comprises a body having top and bottom sides and front and back ends and at least one mechanism for detachably mounting the body on the shoe without unlacing the shoelace. Preferably the body comprises at least one hole extending through the body for insertion of a shoelace. A young child can easily and quickly decorate his shoe with the plush toy.

16 Claims, 10 Drawing Sheets

12
22
10
24
24
20

Fig. 8
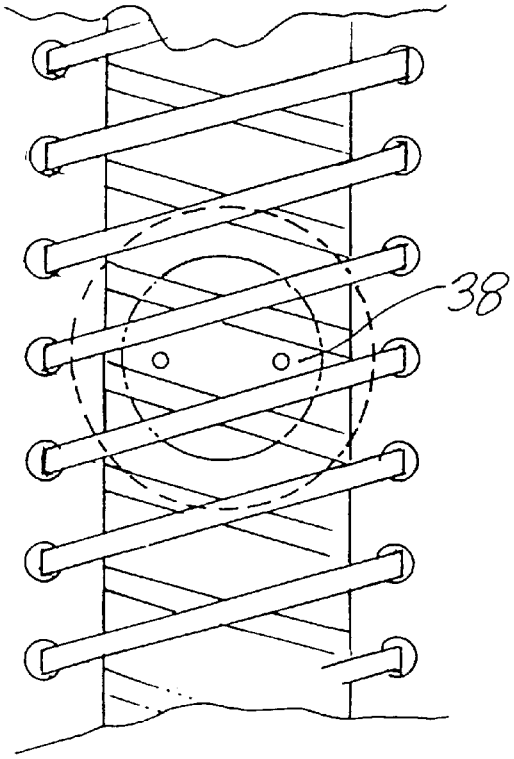
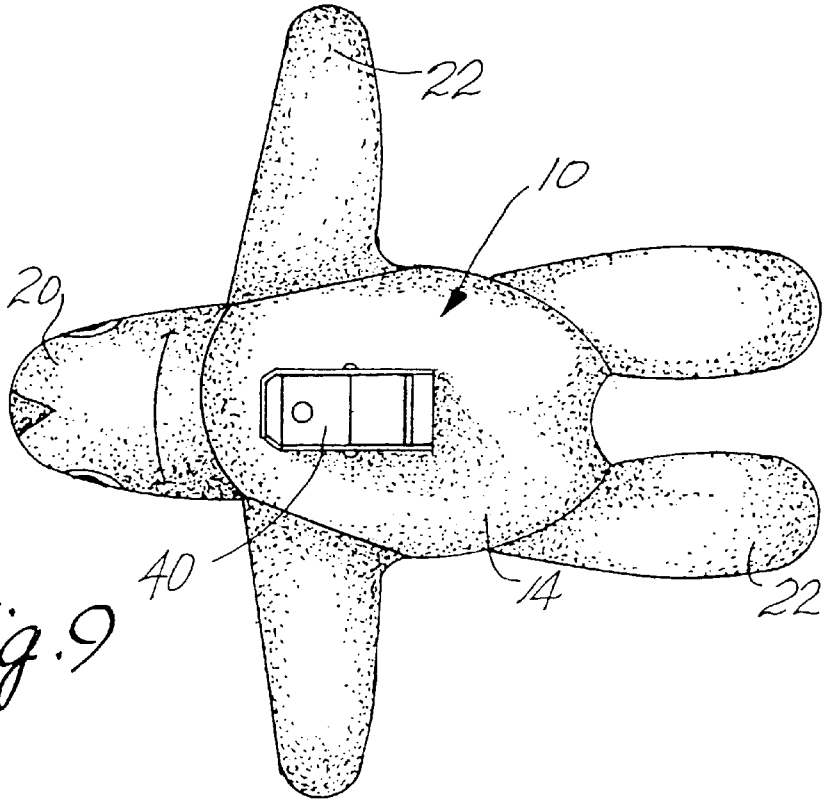
Fig. 9

Fig. 12
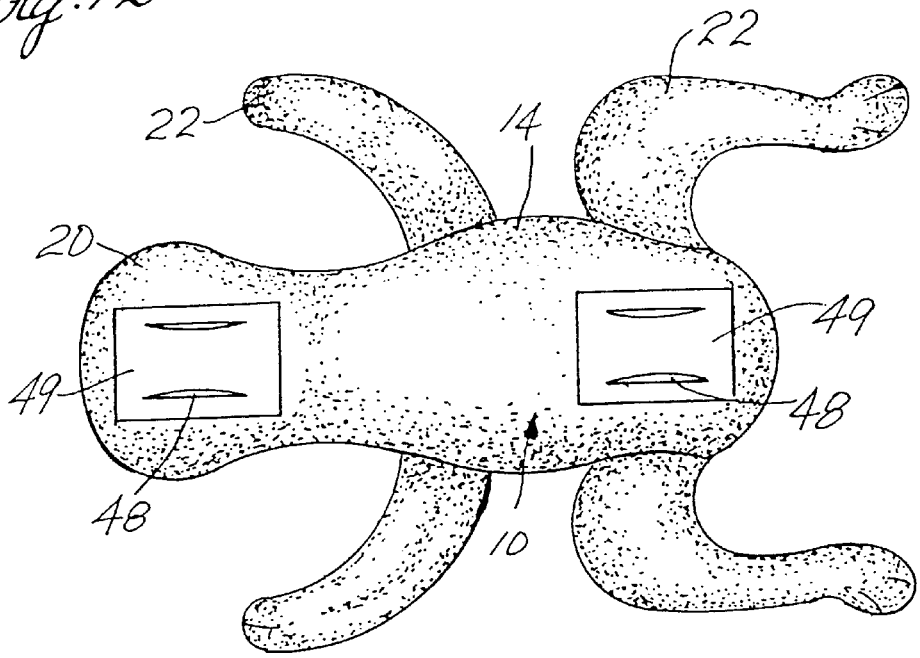
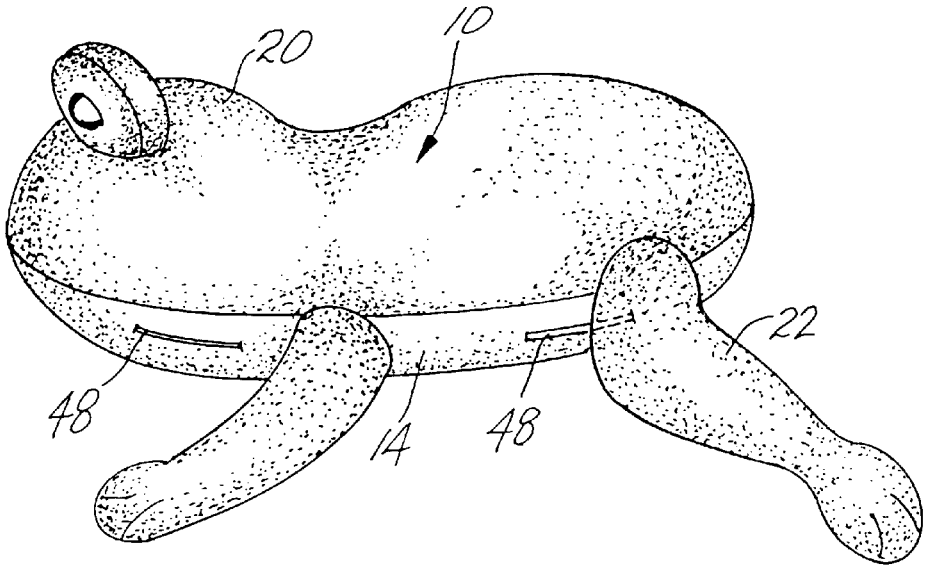
Fig. 13

PLUSH TOY FOR MOUNTING ON A SHOE

RELATED APPLICATIONS

This application is a divisional of U.S. patent application Ser. No. 09/379,712 filed Aug. 24, 1999 now abandoned.

FIELD OF THE INVENTION

The present invention is directed to plush toys that can be detachably mounted on a shoe.

BACKGROUND

Children enjoy novelty items and accessories that they can wear, particularly plush items that resemble cute animals or popular characters. One place where children like to display such items is on their body.

One such plush item is designed to be mounted on a sneaker or other shoe having a shoelace. The plush item has an animal-shaped body with a head and a tail and two small elastic loops attached to the center of the underside of the body in a longitudinal relationship, i.e., with one loop closer to the head and the other loop closer to the tail. The loops are just large enough to fit a shoelace through. However, for a child to put such a toy onto her shoe, she must unlace the entire shoelace and then relace the shoe, putting the shoelace through the elastic loops. The plush item must be mounted and the shoelace relaced so that the elastic loop nearer the head is mounted on a section of shoelace near the front of the shoe and the elastic loop nearer the tail is mounted on a section of shoelace farther back. Such a design has drawbacks because it is extremely difficult for young children to mount the plush item and relace the shoe to obtain the proper placement of the plush item. Another drawback occurs when a young child repeatedly insists that an adult remove the plush item and replace it with a different item on the shoelace, because the adult must repeatedly unlace and relace the shoe. Another drawback to this design is that the plush item does not fasten securely onto the shoe and bounces all over the shoe when the user is walking.

Accordingly, a need exists for a more practical and less time-consuming approach to mounting plush items on shoes that addresses these drawbacks.

SUMMARY OF THE INVENTION

The present invention is directed to plush toys that can be detachably mounted on shoes without having to unlace a shoelace. Additionally, the plush toys of the invention can be stably mounted on the shoes.

In one embodiment, the invention is directed to a plush toy capable of being detachably mounted on a shoe having a shoelace. The plush toy comprises a body having top and bottom sides and front and back ends. The body further comprises at least one means for detachably mounting the body on the shoe without unlacing the shoelace. The means for detachably mounting the body on the shoe without unlacing the shoelace may also be a means for detachably mounting the body on the shoe without untiing the shoelace. Examples of means for detachably mounting the body on the shoe without unlacing the shoelace include, but are not limited to, at least one hole extending through the body, a button attached to the bottom side of the body, a clip attached to the bottom side of the body, a strap attached to the bottom side of the body the strap having at least one free end, a pair of slots provided on the bottom side of the body, wherein the slots are both provided the same distance from the front end of the body, and at least one hook mounted on the bottom side of the body. Other such means are described through the detailed description.

In another embodiment, the invention is directed to a plush toy capable of being detachably mounted on a shoe. The plush toy comprises a body having top and bottom sides, front and back ends and a length ranging from about 0.5 inch to about 8 inches. The body has at least one hole extending therethrough, and preferably two holes extending therethrough. Preferably the holes extend through the body from the top side of the body to the bottom side of the body and are approximately the same distance from the front end of the body.

In still another embodiment, the invention is directed to a method for mounting a plush toy on a shoe having a shoelace without unlacing the shoelace. The method comprises providing a shoe having a shoelace with two free ends and providing a plush toy comprising a body having top and bottom sides and front and back ends. The body has at least one hole extending therethrough. The free ends of the shoelace are inserted through the at least one hole and are tied together.

In yet another embodiment, the invention is directed to a method for mounting a plush toy on a shoe having a strap. The method comprises providing a plush toy comprising a body having top and bottoms sides and a slot on the bottom side of the body and inserting the strap of the shoe through the slot.

In still yet another embodiment, the invention is directed to a display device for a plush toy comprising a body having top and bottom sides front and back ends and at least one hole extending therethrough. The display device comprises a generally flat display structure having a front side, a back side and two shoelace holes, a hanging means for hanging the display structure, and a shoelace having two ends. Each end of the shoelace is inserted through a different corresponding shoelace hole. The plush toy is then mounted on the front side of the display device by inserting the ends of the shoelace through the at least one hole extending through the body of the plush toy and attaching the ends of the shoelace together.

DESCRIPTION OF THE DRAWINGS

These and other features and advantages of the present invention will be better understood by reference to the following detailed description when considered in conjunction with the accompanying drawings wherein:

FIG. 8 is a top view of a section of shoelace with a button mounted therein in accordance with the invention, with the plush toy not shown for clarity.

FIG. 9 is a bottom view of a plush toy in accordance with the invention having a clip mounting means.

FIG. 12 is a bottom view of a plush toy in accordance with the invention having slots on a its bottom side formed with fabric patches.

FIG. 13 is a side view of a plush toy in accordance with the invention having slots on its bottom side comprising holes through the bottom side of the body of the toy.

DETAILED DESCRIPTION

Figure 1:
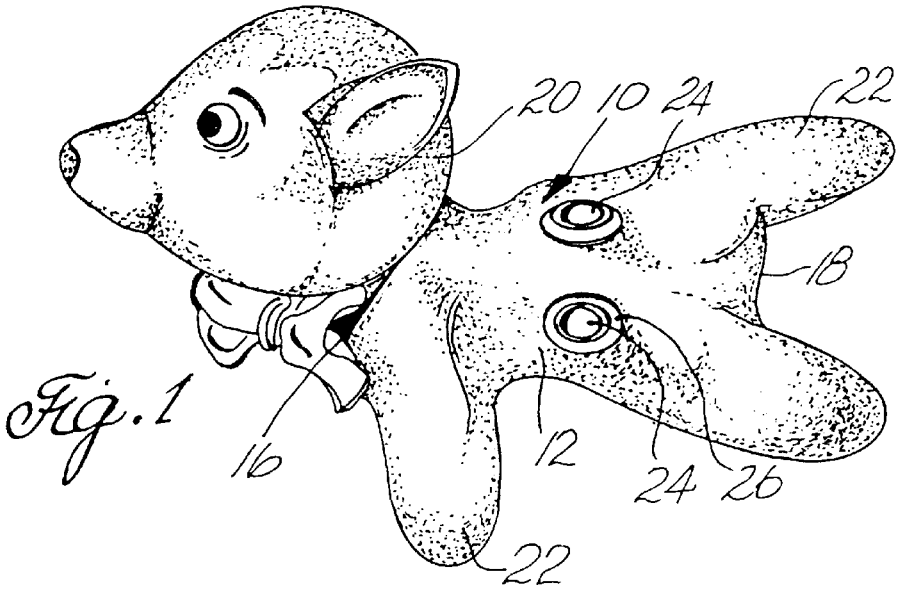
FIG. 1 is a perspective view of a plush toy in accordance with the invention having two shoelace holes.
Figure 2:
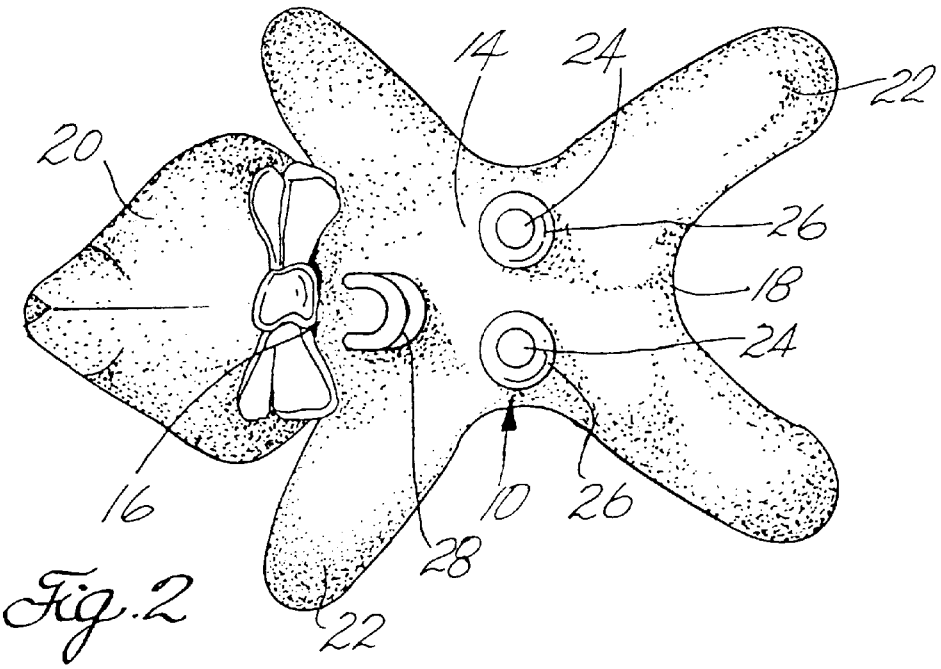
FIG. 2 is a bottom view of the plush toy of FIG. 1.

The present invention is directed to plush toys that can be detachably mounted on shoes. As shown in FIGS. 1 and 2, the plush toy has a body 10 having a top side 12, a bottom side 14, a front end 16, and a back end 18. The plush toy is preferably in the shape of an animal or other character and has a head 20 mounted thereon, preferably on its front end 16. The body 10 can be any suitable shape, such as generally rectangular, circular or oval. If desired the body 10 can comprise one or more legs 22 extending therefrom. Alternatively, the plush two can be any other suitable shape, such as resembling sports equipment. The length of the plush toy, including the body 10, and head 20 and legs 22 if included, preferably ranges from about 0.5 inch to about 8 inches, more preferably from about 1 inch to about 5 inches, still more preferably from about 2 inches to about 4 inches.

As used herein, the term "plush toy" refers to a generally soft toy having a body 10 made of a soft, flexible material. Preferably the head 20 of the plush toy is also made of a generally soft, flexible material. Suitable flexible materials for the body include cotton, polyester silk, wool, leather, taffeta, velvet, crepe, denim, rayon, nylon, plastic and the like. If desired the body 10 and/or head 20 can contain a suitable filler or stuffing, such as cotton, polyester, plastic or glass beads or pellets, sand, feathers, foam and the like.

In the embodiment depicted in FIGS. 1 and 2, the plush toy has two shoelace holes 24 that pass through the body 10 from its top side 12 to its bottom side 14. The two shoelace holes 24 are preferably provided close to the midsection of the body 10, and more preferably are provided a distance from the front end of the body 10 equal to about 35% to about 65% of the length of the body, more preferably a distance from the front end of the body equal to about 45% to about 60% of the length of the body.

A reinforcement member 26 is provided in each shoelace hole 24 to reinforce that hole. In the depicted embodiment, each reinforcement member 26 is a round metal eyelet. The reinforcement member 26 can be any other suitable shape or material that reinforces the hole, e.g., a round or square reinforcement made of fabric or plastic. The two shoelace holes 24 are positioned next to each other so that they are approximately the same distance from the front end 16 of the body 10, although they can be provided at different distances from the front end if desired. The shoelace holes 24 can be provided at any point along the length of the body 10, including in the legs 22.

Figure 3:
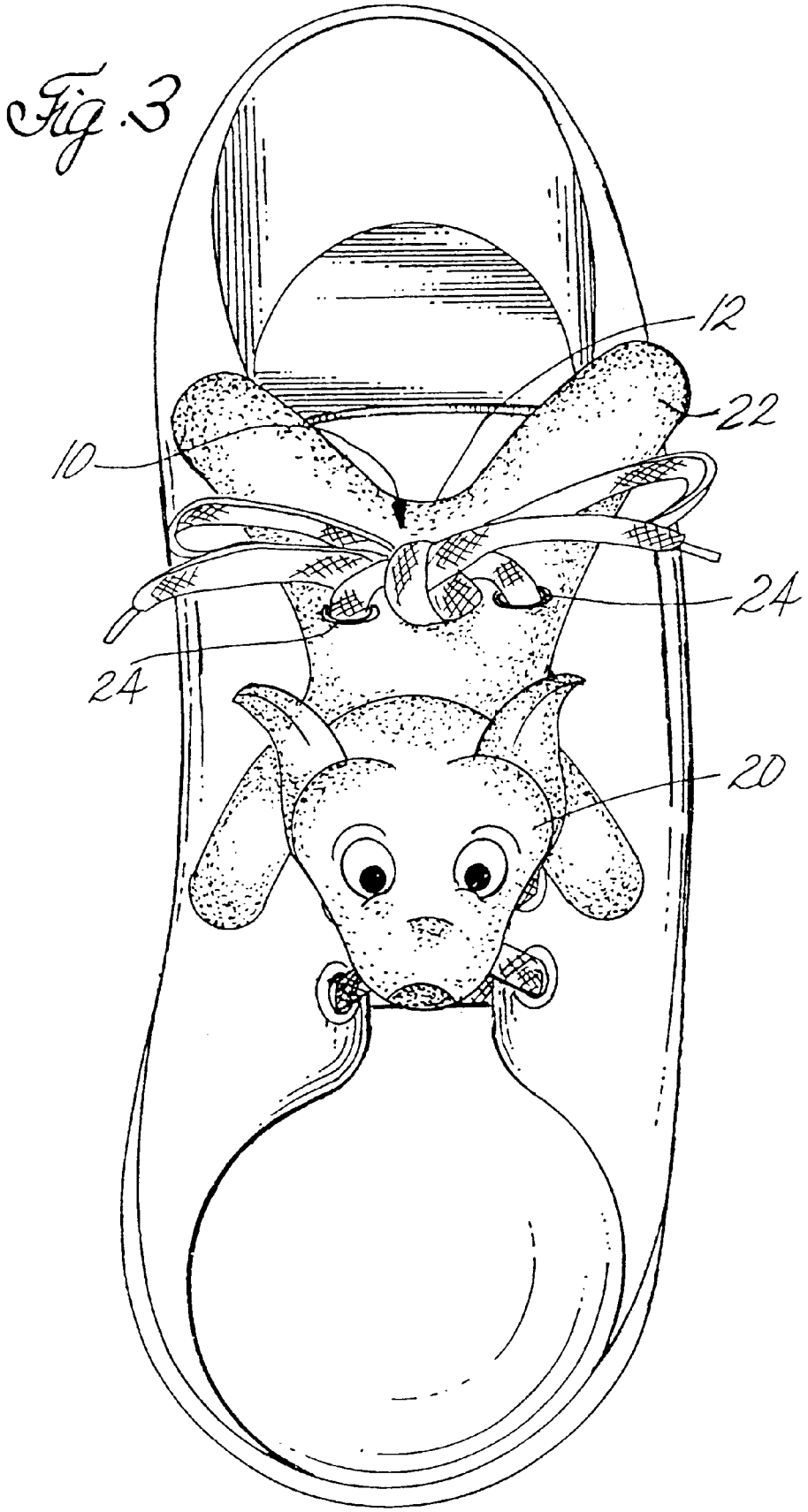
FIG. 3 is a top view of a shoe having a plush toy mounted thereon in accordance with the invention.

In use, as shown in FIG. 3, the plush toy is placed on top of a shoe with the front end of the plush toy facing the front end of the shoe, and the two ends of the shoelace are each pulled through the bottom of a different one of the shoelace holes 24 and out through the tops of the holes. The ends of the shoelace are then tied over the top side 12 of the plush toy. With this design, it is unnecessary for the user to unlace the shoe prior-to-mounting and removing the plush toy, so the toy can be put onto and removed from the shoe quickly and easily, particularly for young children.

Additionally, a hook 28 is provided on the bottom side 14 of the plush toy near its front end 16. The hook 28 acts to further stabilize the plush toy on the shoe. In use preferably the hook 28 is hooked onto a section of the shoelace closer to the front end of the shoe to generally position the plush toy, and then ends of the shoelace are pulled through the shoelace holes 24 as described above.

Figure 4:
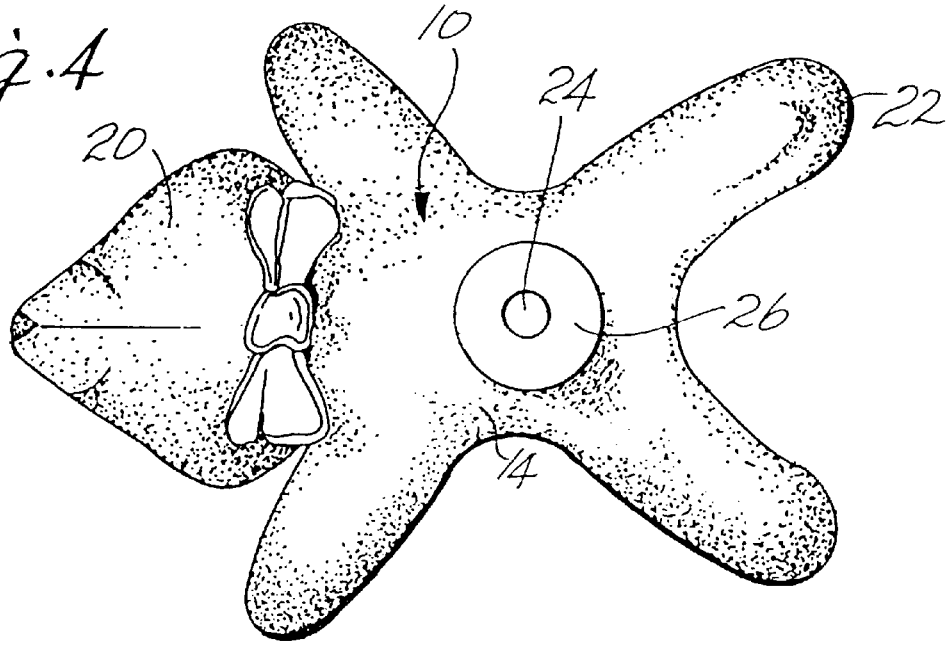
FIG. 4 is a bottom view of a plush toy in accordance with the invention having a single shoelace hole.
Figure 5:
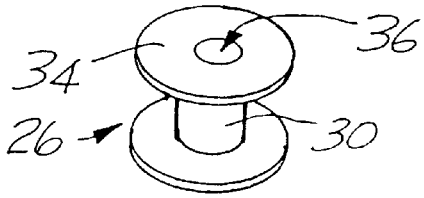
FIG. 5 is a perspective view of a reinforcement member for insertion into a shoelace hole of a plush toy in accordance with the invention.

Alternatively, the plush toy can be provided with a single shoelace hole 24, as shown in FIG. 4. In this embodiment, a reinforcement member 26 is also provided in the hole 24. As best shown in FIG. 5, the reinforcement member 26 is plastic and comprises a cylindrical stem 30 having two ends and a passage therethrough, with two plates 34 mounted on the ends in perpendicular relation to the stem. The plates 34 each have an opening 36 therethrough in alignment with the passage, and preferably each opening is in the center of each plate. With this design, the reinforcement member 26 not only acts to reinforce the shoelace hole 24, but also provides additional stability when the plush toy is mounted on a shoe due to the plates 34. The plates 34 can be any suitable shape, such as round or square, and any suitable size, but preferably do not have a diameter equal to more than half the width or length of the body 10. In use, both ends of a shoelace are inserted through the single shoelace hole 24 in the plush toy and tied over the top side 12 of the plush toy. If desired, a hook can be provided as described above to further anchor the plush toy onto the shoe.

Figure 6:
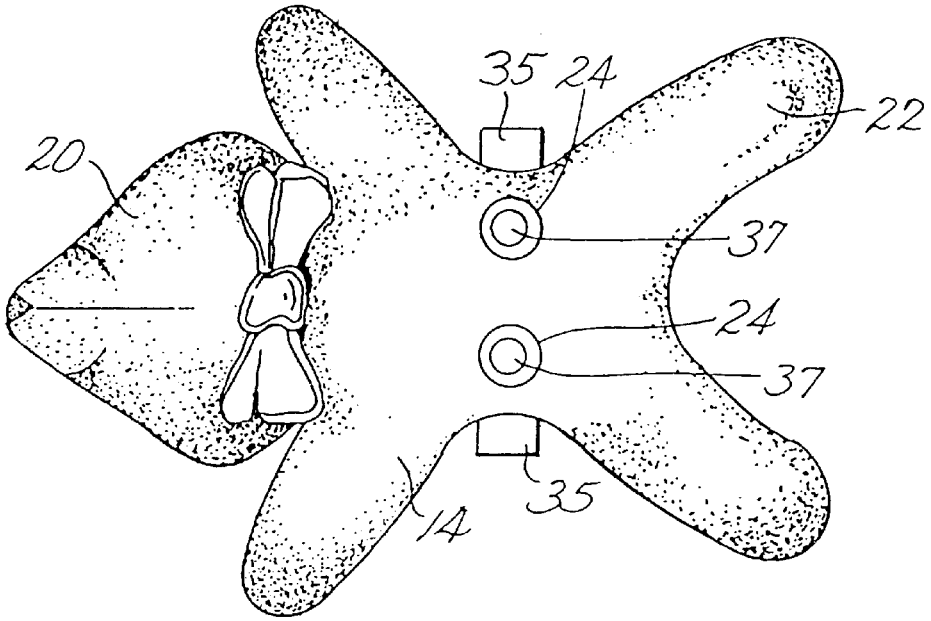
FIG. 6 is a bottom view of a plush toy in accordance with the invention having two cord clamps mounted in the body.

In another embodiment, as shown in FIG. 6, the plush toy further comprises two cord clamps 35 for holding the shoelaces in place. Specifically, the plush toy comprises two shoelace holes 24, similar to the embodiment of FIGS. 1 and 2. Two cord clamps 35 are mounted within the body 10, each corresponding to a different shoelace hole 24. Suitable cord clamps 35 for use with the present invention are disclosed in U.S. Pat. No. 4,328,605, the entire disclosure of which is incorporated herein by reference. For example, each cord clamp 35 is formed of two pieces each having a hole 37 therethrough that are moveable relative to each other between an. open position (by pushing the pieces together) and a closed default position (by releasing the pieces). In the open position, the pieces are arranged so that the holes 37 are aligned with each other so that a shoelace can be fed therethrough. In the closed position, the holes 37 are not aligned with each other, thus clamping in place a shoelace that had been fed through the holes and holds the toy in place on the lace even if the lace comes untied. The cord clamps 35 are mounted within the body 10 of the plush toy so that, when each cord clamp is in the open position, the holes 37 of that cord clamp are aligned with a corresponding shoelace hole 24. In the depicted embodiment, one end of each cord clamp 35 extends outside the body 10, although the entire cord clamp could be mounted in the body if desired.

Figure 7:
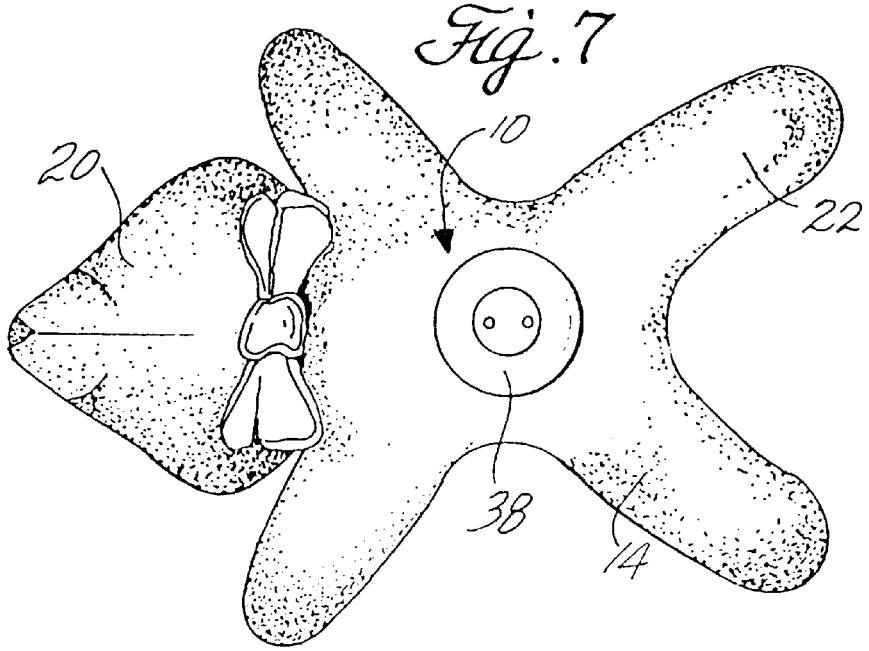
FIG. 7 is a bottom view of a plush toy in accordance with the invention having a button mounting means.

Another embodiment of the invention is shown in FIG. 7. In this embodiment, instead of holes, the plush toy has a button 38 attached to its bottom side 14. In the depicted embodiment the button 38 is round, but can be any other suitable shape, such as oval or square. In use, the button 38 is inserted between two adjacent sections of shoelace so that the edges of the button are underneath the shoelaces, as shown in FIG. 8. The button 38 can be of any suitable size so long as it has a large enough diameter so that the edges can be held in place underneath two adjacent sections of shoelace as described above. Preferably the button 38 has a length or diameter ranging from about 0.5 inch to about 2 inches. If the button is too long, it can be difficult, particularly for a young child, to insert the button between adjacent sections of shoelace. With this embodiment, not only is it unnecessary to unlace the shoelace to mount the plush toy in place, but it is unnecessary to even untie the shoelace. Alternatively, this embodiment can be used in combination with a specially-designed shoe having slots or the like in the tongue to receive the button.

In another embodiment, as shown in FIG. 9, the plush toy has a clip 40, such as an alligator clip or the like, attached to its bottom side 14. In use, the plush toy is clipped to a section of shoelace. With this embodiment, like that described above, it is unnecessary for the user to even untie the shoelace to mount the plush toy onto the shoe. The clip 40 can be of any suitable length. For example, in the embodiment of FIG. 8, the clip 40 has a length sufficient to clip onto a single section of shoelace. Alternatively, a longer clip can be provided so that one arm of the clip can be inserted under and clipped to multiple sections of shoelace. If desired, multiple clips can be provided along the length of the bottom side 14, or a clip 40 can be combined with a hook 28, described above. By providing multiple mounting means particularly along the length of the bottom side 14 (i.e., with one mounting means closer to the front end 16 than the other mounting means), the stability of the plush toy is even further enhanced. In another alternative, a snap is provided as a second mounting means. One half of the snap is attached to the bottom side 14 of the plush toy, and the other half of the snap is attached to the shoelace. However, with this embodiment, care must be taken when the shoelace is inserted into the shoe so that the half of the snap on the shoelace is in a suitable position to mate with the snap on the bottom side of the plush toy when the toy is mounted on the shoe.

Figure 10A:
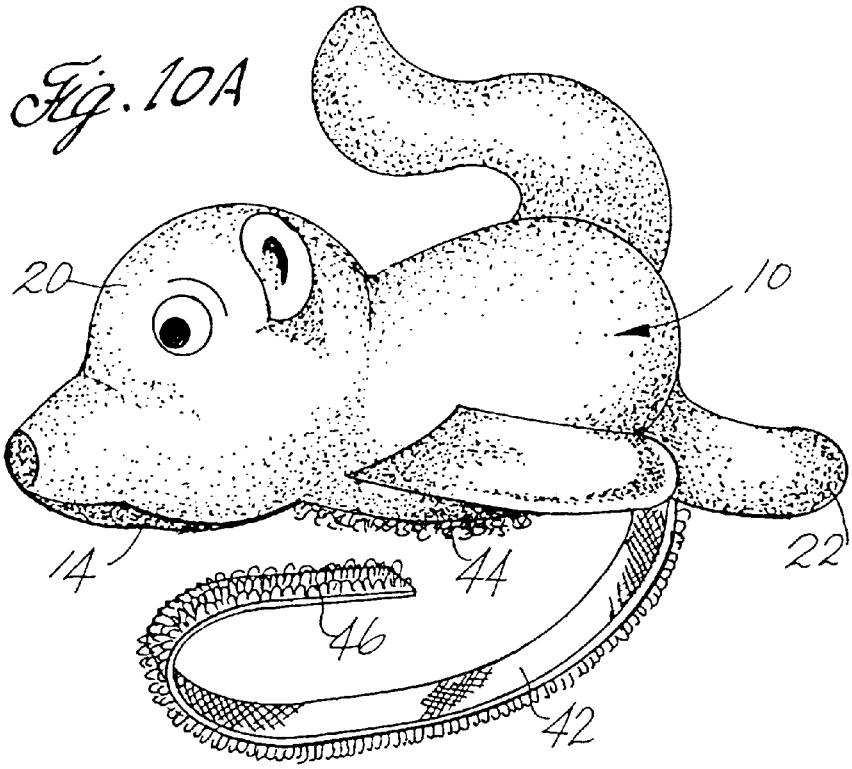
FIGS. 10A and 10B are side views of a plush toy in accordance with the invention having a strap mounting means with a free end, in an open position and a closed position, respectively.
Figure 10B:
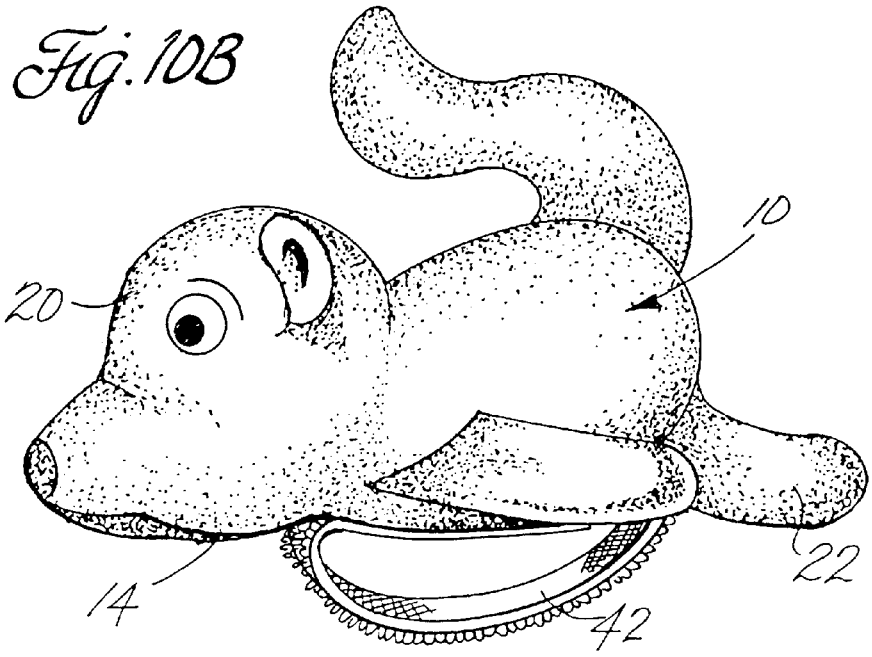

In yet another embodiment, as shown in FIGS. 10A and 10B, a strap 42 having at least one free end is provided on the bottom side 14 of the body 10. In the depicted embodiment the strap 42 has a first end 44 attached to the bottom side 14 of the body and a second end 46 not attached to the body, i.e., a free end. Both ends are provided with a fastening tape, such as Velcro, i.e., one side having hooks and the other side having loops to which the hooks releasably engage. In use, the second (free) end 46 of the strap 42 is inserted under one or more sections of shoelace, pulled up through the shoelace and attached to the first end 44 of the strap. As would be recognized by one skilled in the art, other designs could be provided for the strap having at least one free end. For example, the strap 42 could be provided with two free ends and the midsection of the strap 42 could be attached to the bottom side 14 of the body 10. The first end 44 and second end 46 are not attached to the body so that the ends 44 and 46 are both inserted under sections of shoelace. This embodiment also provides a mounting means that does not require that the shoelace be unlaced or untied to mount the plush toy on the shoe.

Figure 11:
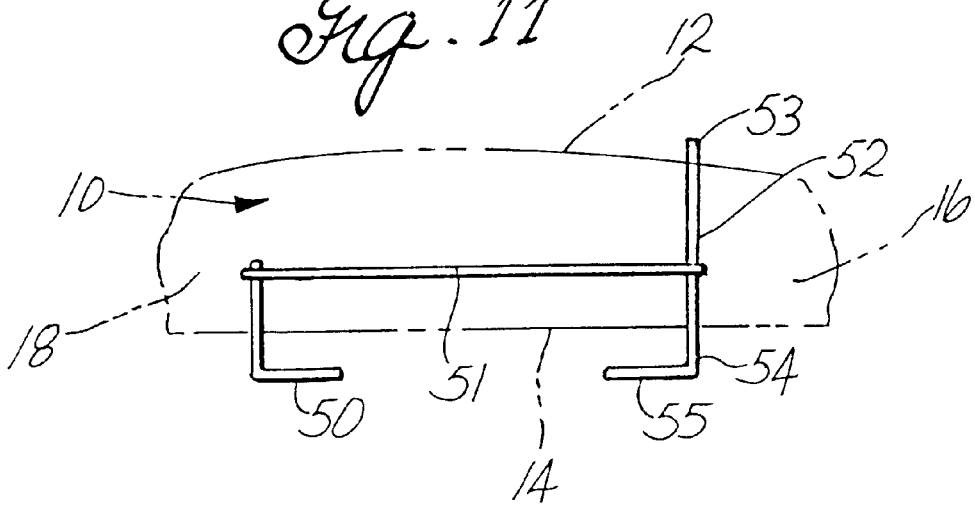
FIG. 11 is a side schematic view of a hook and lever mounting means mounted in the body (shown in phantom) of a plush toy in accordance with the invention.

In another embodiment, shown in FIG. 11, the plush toy is provided with a hook and lever mounting means. Specifically, a permanent hook 50 is fixedly mounted to the bottom side 14 of the body 10 near one end, which in the depicted embodiment is near the back end 18. The permanent hook 50 faces toward the center of the body 10. Within the body 10, shown in phantom in FIG. 11, an elastic band 51 having first and second ends is fixedly attached at its first end to the permanent hook 50. Alternatively, the first end of the elastic band 51 can be fixedly attached to some other anchor point within the body near the same end of the body to which the permanent hook 50 is attached. The second end of the elastic band 51 is fixed attached to a lever 52 that extends generally vertically through the body 10. The lever 52 has a top end 53 that extends out of the top side 12 of the body 10 and a bottom end 54 the extends out of the bottom side 14 of the body. The bottom end 54 of the lever 52 comprises a slidable hook 55 that also faces toward the center of the body 10, and thus faces toward the permanent hook 50. In use, the child hooks the permanent hook 50 onto a section of shoelace, mounting the plush toy onto the shoe. The child then pulls the top end 53 of the lever 52 away from the permanent hook 50, thereby sliding the slidable hook 55 away from the permanent hook, and hooks the slidable hook onto another section of shoelace. When the child releases the lever 52, the elastic band 51 pulls the slidable hook 55 toward the permanent hook 50, holding the toy stably in place. If desired, the elastic band 51 could be replaced with a spring or the like, and the top end 53 of the lever 52 can be covered with fabric or other soft material to protect the child from injury. Alternatively, the lever 52 does not extend out the top side 12 of the body 10. In use, the child hooks the permanent hook 50 onto a section of shoelace, then pulls the toy away from the permanent hook, thus stretching the elastic band 51. While the band 51 is stretched the child hooks the slidable hook 55 onto another section of shoelace. When the child releases the toy, the elastic band 51 pulls the slidable hook 55 toward the permanent hook 50, as described above. With this embodiment, it is unnecessary for the child to unlace or untie the shoelace to mount the plush toy on the shoe. Additionally, this embodiment can be used on shoes of varying sizes.

In another embodiment, the invention is directed to a method for mounting a plush toy on a shoe having one or more straps, such as leather straps with a buckle, and more particularly to a shoe having one or more Velcro straps. Such shoes are well known, particularly in the sneaker industry. Instead of having a series of shoelace holes along the top of the shoe for insertion of a shoelace, the shoe has generally two straps, each of which is attached at one end to one side of the shoe. The other side of the shoe has two corresponding holes through which the straps can be inserted. Once the straps are inserted into the holes, they fold over onto themselves, forming an interior surface. The interior surface is covered with Velcro so that, when the strip is folded over, it can be removably attached to itself. The Velcro strip allows the user to fold each strip over on itself to any desired degree depending on how tight or lose the user wants to wear the shoe.

As shown in FIG. 12, the plush toy-of this embodiment has a body 10, as described above, with one or more slots 48 on the bottom side 14 of the body. In the depicted embodiment, two slots 48 are provided, but additional slots could be provided depending upon the number of straps present on the shoe on which the plush toy is to be mounted. The slots 48 are each positioned along the length of the body 10 in parallel relation to the length of the body, with one slot closer to the front end 16 of the body and one slot closer to the back end 18 of the body. The slots 48 are spaced apart from each other a distance generally equal to the distance between the straps on the shoe so that the straps can easily be pulled through the slots. Preferably the slots 48 are sufficiently long to accommodate the width of a strap, and more particularly a Velcro strap, and preferably have a length of from about 0.50 inch to about 1 inch, more preferably from about 0.60 inch to about 0.90 inch. In the depicted embodiment, the slots 48 are formed with patches 49 of leather or other suitable fabric sewn or otherwise attached to the bottom side 14 of the body 10. The slots 48 could be formed in any suitable manner, for example, by providing, loops formed of elastic or another fabric onto the bottom side of the body. Alternatively, each slot 48 can be formed by providing a hole through the bottom side 14 of the body 10, as shown in FIG. 13. If desired, a single slot 48 can be provided that accommodates two or more straps. For example, a strap 42 having a free end, as shown in FIGS. 10A and 10B and described above, can be used to form a single slot 48 through which multiple straps can extend; alternatively, a single permanently closed strap can be provided through which multiple straps can be inserted.

Figure 14:
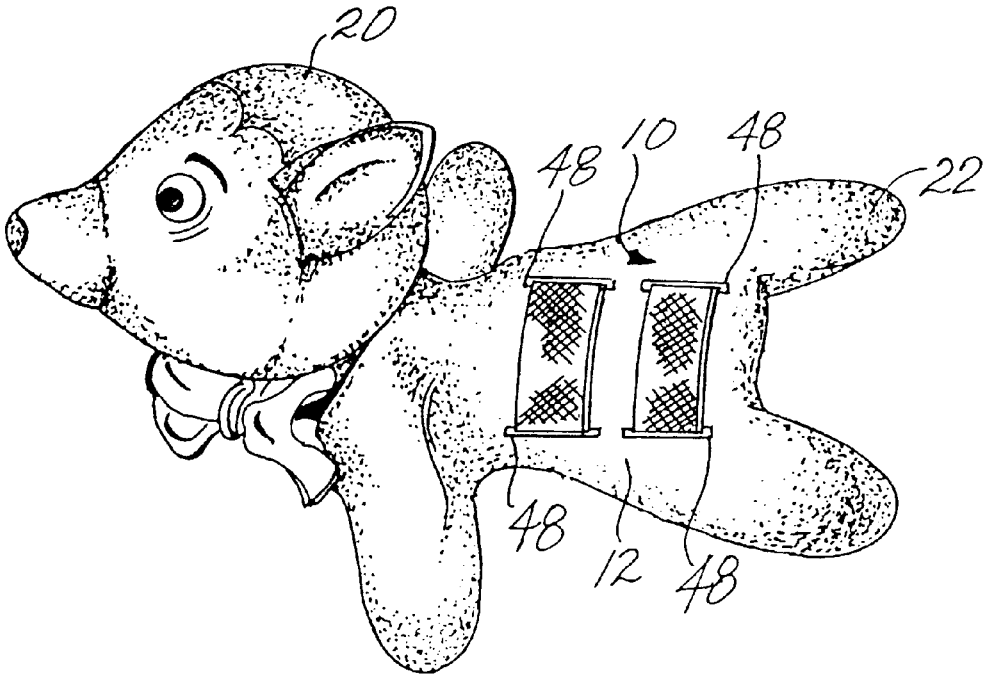
FIG. 14 is a perspective view of a plush toy in accordance with the invention have two pairs of slots through the body.

In yet another alternative embodiment, as shown in FIG. 14, the body 10 comprises two pairs of slots 48. Both slots 48 of a single pair are provided approximately the same distance from the front end 16 of the body, with one pair of slots closer to the front end 16 of the body and one pair of slots closer to the back end 18 of the body. Each slot extends complete through the body 10 from its bottom side 14 to its top side 12. A shoe strap is inserted up through the bottom of one slot of a pair, over the top side 12 of the body, and down through the other slot of the pair. A second shoe strap is inserted in a similar manner. If desired, the body 10 could be provided with a single pair of slots 48, with both slots of the pair being approximately the same distance from the front end 16 of the body, for insertion of a single shoe strap through the plush toy. Alternatively, one or more pairs of slots 48 can be provided that are formed with patches of fabric attached to the bottom side 14 of the body 10 or by providing fabric loops onto the bottom side of the body, as generally described above.

In an embodiment where a single pair of slots 48 are provided on the bottom side 14 of the body 10 with fabric patches, loops or the like, i.e., with the slots 48 being the same distance from the front end 16 of the body, the slots 48 can also be used for mounting the plush toy on a shoe with a shoelace. Specifically, one free end of the shoelace is pulled through one slot 48 of the pair, the other free end of the shoelace is pulled through the other slot of the pair, and the ends are brought around the body and tied over the top side 12 of the body, as generally described above. With this design, it is unnecessary for the user to unlace the shoelace to mount the plush toy.

Figure 15:
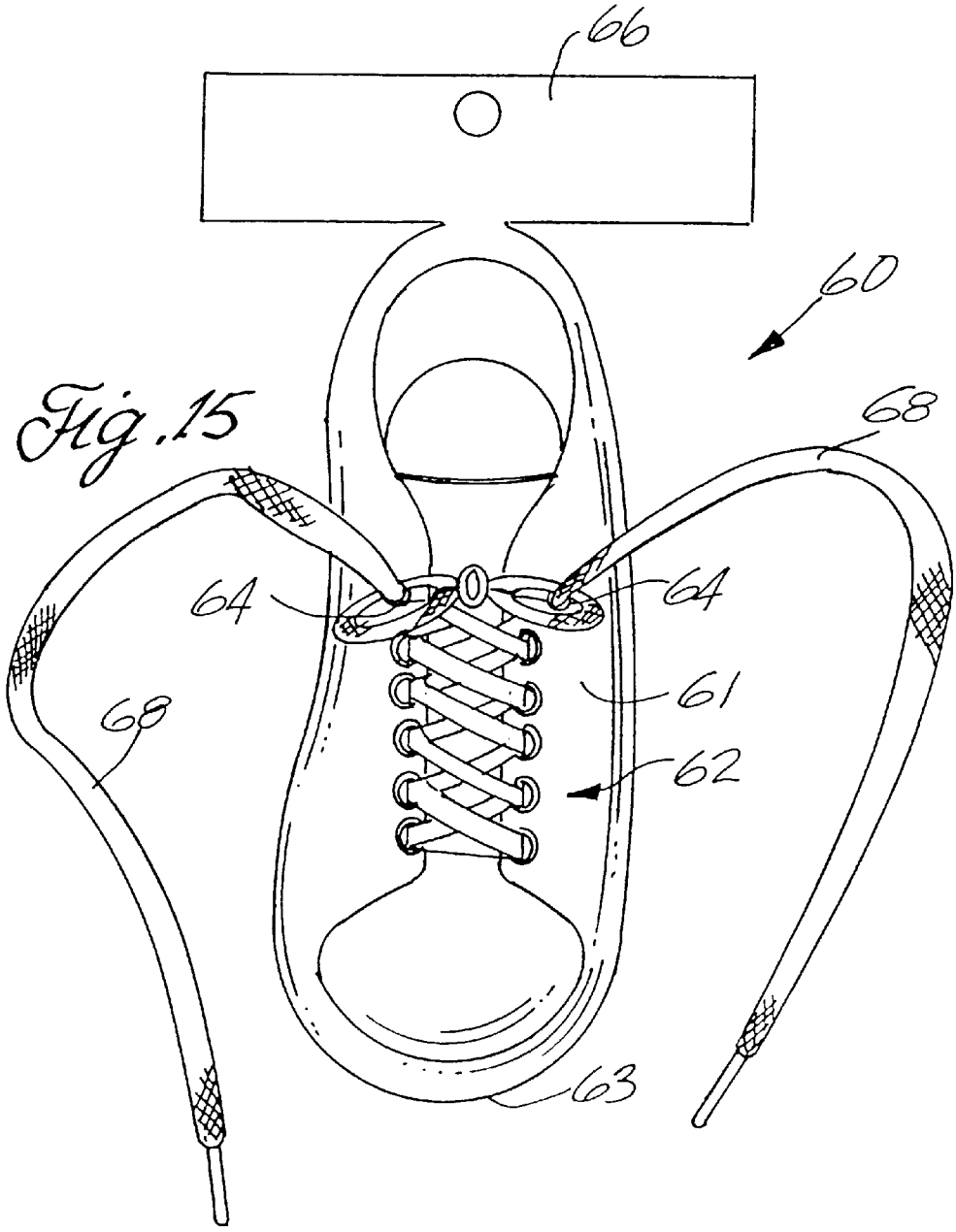
FIG. 15 is a front view of a display device for a plush toy in accordance with the invention.

In another embodiment, the invention is directed to a method and display device for displaying a plush toy that can be detachably mounted on a shoe. As shown in FIG. 15, the display device 60 comprises a generally flat display structure 62 having a front side 61, a back side 63 and two shoelace holes 64 therethrough. A hanging means 66 for hanging the display structure is provided near the top of the display structure 62. Any suitable hanging means 66, such as a hole, a tab having a hole therethrough, a bag or wrap having a hole therethrough, a clip, a hook, a string or band, or the like, can be used. A shoelace 68 or the like is provided so that the ends of the shoelace are inserted through the shoelace holes 64 from the back side 63 of the display device 60 so that the ends can be tied on the front of the display device. A plush toy having two shoelace holes 24, such as that depicted in FIGS. 1 and 2, is mounted on the front side 61 of the display structure 62. The ends of the shoelace 68 are inserted through the shoelace holes 24 of the plush toy and tied, e.g., in a bow, or otherwise attached to each other around the plush toy, in a manner similar to that described above for mounting the toy on a shoe. Preferably the display structure 62 is generally in the shape of a shoe or a has a shoe depicted thereon. With the design, preferably the shoelace holes 64 are positioned on the display structure 62 so that, when a shoelace 68 is inserted through the shoelace holes, it appears as if the shoelace is part of the "shoe" of the display device.

The preceding description has been presented with reference to presently preferred embodiments of the invention. Workers skilled in the art and technology to which this invention pertains will appreciate that alterations and changes in the described structure may be practiced without meaningfully departing from the principal, spirit and scope of this invention.

Accordingly, the foregoing description should not be read as pertaining only to the precise structures described and illustrated in the accompanying drawings, but rather should be read consistent with and as support to the following claims which are to have their fullest and fair scope.

What is claimed is:

1. A method for associating a plush toy with a shoe that includes a shoelace with a first end and a second end comprising the steps of:

threading the first end of the shoelace into a first hole of the plush toy by threading the first end of the shoelace through an entrance of the first hole disposed at a bottom side of the plush toy;

then threading the first end of the shoelace through stuffing disposed within the plush toy;

then threading the first end of the shoelace through an exit of the first hole disposed at a top side of the plush toy;

threading the second end of the shoelace into a second hole of the plush toy by threading the second end of the shoelace through an entrance of the second hole disposed at the bottom side of the plush toy;

then threading the second end of the shoelace through stuffing disposed within the plush toy;

then threading the second end of the shoelace through an exit of the first hole disposed at a top side of the plush toy; and tying the first end of the shoelace with the second end of the shoelace into a conventional shoestring knot, wherein the distance between the first hole and the second hole is small enough to permit the tying of the conventional shoestring knot.

2. The method according to claim 1, wherein the first end of the shoelace is passed through a reinforcing member disposed on the plush toy.

3. The method according to claim 2, wherein the second end of the shoelace is passed through a second reinforcing member disposed on the plush toy.

4. The method according to claim 1, wherein the conventional shoestring knot is formed on the top side of the plush toy.

5. The method according to claim 4, wherein a portion of the shoelace used to form the conventional shoestring knot contacts the top side of the plush toy.

6. The method according to claim 1, further comprising the step of associating a hook disposed on the plush toy with a section of the shoelace.

7. The method according to claim 6, wherein the section of the shoelace is a portion of the shoelace that is different than the first end of the shoelace and different than the second end of the shoelace.

8. The method according to claim 6, wherein the hook is disposed proximate a front end of the plush toy and the hook is associated with a section of the shoelace closer to a front end of the shoe than a body of the plush toy.

9. A method for associating a plush toy with a shoe that includes a shoelace with a first end and a second end comprising the steps of:

threading the first end of the shoelace into a first hole of the plush toy by threading the first end of the shoelace through an entrance of the first hole disposed on a first side of the plush toy;

then threading the first end of the shoelace through stuffing disposed within the plush toy;

then threading the first end of the shoelace through an exit of the first hole disposed on a second side of the plush toy;

threading the second end of the shoelace into a second hole of the plush toy by threading the second end of the shoelace through an entrance of the second hole disposed on the first side of the plush toy;

then threading the second end of the shoelace through stuffing disposed within the plush toy; and then threading the second end of the shoelace through an exit of the first hole disposed on the second side of the plush toy.

10. The method according to claim 9, wherein the first end of the shoestring is threaded through the first hole of the plush toy at a distance from a first end of the body equal to about 35% to 65% of the length of the body.

11. The method according to claim 9, further comprising the step of tying the first end of the shoelace with the second end of the shoelace into a conventional shoestring knot.

12. The method according to claim 11, wherein the distance between the first hole and the second hole is small enough to permit the tying of the conventional shoestring knot.

13. The method according to claim 9, wherein the conventional shoestring knot is formed on the second side of the plush toy and wherein a portion of the shoelace used to form the conventional shoestring knot contacts the second side of the plush toy.

14. The method according to claim 9, further comprising the step of associating a hook disposed on the plush toy with a section of the shoelace.

15. The method according to claim 14, wherein the section of the shoelace is a portion of the shoelace that is different than the first end of the shoelace and different than the second end of the shoelace.

16. The method according to claim 15, wherein the hook is disposed proximate a front end of the plush toy and the hook is associated with a section of the shoelace closer to a front end of the shoe than a body of the plush toy.

* * * * *